US007810584B2

(12) United States Patent
Haci et al.

(10) Patent No.: US 7,810,584 B2
(45) Date of Patent: Oct. 12, 2010

(54) METHOD OF DIRECTIONAL DRILLING WITH STEERABLE DRILLING MOTOR

(75) Inventors: Marc Haci, Katy, TX (US); Eric E. Maidla, Sugar Land, TX (US)

(73) Assignee: Smith International, Inc., Houston, TX (US)

( * ) Notice: Subject to any disclaimer, the term of this patent is extended or adjusted under 35 U.S.C. 154(b) by 200 days.

(21) Appl. No.: 11/524,009

(22) Filed: Sep. 20, 2006

(65) Prior Publication Data

US 2008/0066958 A1 Mar. 20, 2008

(51) Int. Cl.

| | |
|---|---|
| ***E21B 7/04*** | (2006.01) |
| ***E21B 4/00*** | (2006.01) |
| ***E21B 3/00*** | (2006.01) |
| ***E21B 7/20*** | (2006.01) |

(52) U.S. Cl. ..... 175/61; 175/92; 175/170; 175/27

(58) Field of Classification Search ..... 175/27, 175/24, 45, 61

See application file for complete search history.

(56) References Cited

U.S. PATENT DOCUMENTS

| | | | | |
|---|---|---|---|---|
| 4,739,842 | A * | 4/1988 | Kruger et al. | 175/61 |
| 5,107,939 | A * | 4/1992 | Lenhart et al. | 175/61 |
| 5,458,208 | A * | 10/1995 | Clarke | 175/45 |
| 5,465,799 | A * | 11/1995 | Ho | 175/61 |
| 6,050,348 | A | 4/2000 | Richarson et al. | |
| 6,158,533 | A * | 12/2000 | Gillis et al. | 175/325.1 |
| 6,415,878 | B1 * | 7/2002 | Cargill et al. | 175/61 |
| 6,438,495 | B1 * | 8/2002 | Chau et al. | 702/9 |
| 6,802,378 | B2 | 10/2004 | Maidla et al. | |
| 6,918,453 | B2 | 7/2005 | Maidla et al. | |
| 7,096,979 | B2 | 8/2006 | Maidla et al. | |
| 7,147,066 | B2 * | 12/2006 | Chen et al. | 175/61 |
| 7,306,054 | B2 * | 12/2007 | Hutchinson | 175/45 |
| 2002/0104685 | A1 * | 8/2002 | Pinckard et al. | 175/61 |
| 2004/0118608 | A1 * | 6/2004 | Haci et al. | 175/26 |
| 2004/0118612 | A1 * | 6/2004 | Haci et al. | 175/61 |
| 2004/0195004 | A1 * | 10/2004 | Power et al. | 175/24 |
| 2004/0222023 | A1 * | 11/2004 | Haci et al. | 175/61 |
| 2005/0077084 | A1 * | 4/2005 | Kracik et al. | 175/24 |
| 2005/0133259 | A1 * | 6/2005 | Koederitz | 175/27 |
| 2005/0194183 | A1 * | 9/2005 | Gleitman et al. | 175/45 |
| 2006/0081399 | A1 * | 4/2006 | Jones | 175/61 |
| 2006/0185900 | A1 * | 8/2006 | Jones et al. | 175/26 |
| 2006/0266555 | A1 * | 11/2006 | Chen et al. | 175/61 |
| 2006/0283632 | A1 * | 12/2006 | Hall et al. | 175/26 |

OTHER PUBLICATIONS

Maidla, Haci "Understanding Torque: The key to slide-drilling directional wells" Society of Petroleum Engineers, IADC/SPE 87162 Drilling conference, presented Mar. 2-4, 2004.*

* cited by examiner

*Primary Examiner*—David J Bagnell
*Assistant Examiner*—Cathleen R Hutchins

(57) ABSTRACT

Drilling a bore hole comprises rotary drilling at a first rotation rate until a first target value is substantially met, changing the first rotation rate to a second rotation rate when a trigger is substantially met, and then drilling at the second rotation rate until a second target value is substantially met. Preferably, the second rotation rate is substantially zero, so the drilling at the second rotation rate is slide drilling. Finally, the steps of rotary drilling at a first rotation rate, changing the rotation rate to a second rotation rate, and drilling at the second rotation rate are repeated.

15 Claims, 6 Drawing Sheets

METHOD OF DIRECTIONAL DRILLING WITH STEERABLE DRILLING MOTOR

CROSS-REFERENCES TO RELATED APPLICATIONS

Not Applicable

FEDERALLY SPONSOR RESEARCH OR DEVELOPMENT

Not Applicable

SEQUENCE LISTING, TABLE, OR COMPUTER LISTING

Not Applicable

BACKGROUND OF THE INVENTION

1. Field of the Invention

This invention relates generally to the field of oil and gas well drilling. More particularly, the invention relates to the field of directional drilling. Specifically, the invention is a method of and an apparatus for directional drilling with a steerable drilling motor.

2. Description of the Related Art

It is very expensive to drill bore holes in the earth such as those made in connection with oil and gas wells. Oil and gas bearing formations are typically located thousands of feet below the surface of the earth. Accordingly, thousands of feet of rock must be penetrated in order to reach the producing formations. Additionally, many wells are drilled directionally, wherein the target formations may be located thousands of feet from the well's surface location. Thus, in directional drilling, not only must the depth be penetrated, but the lateral distance of rock must also be penetrated.

The cost of drilling a well is primarily time dependent. Accordingly, the faster the desired penetration location is reached, both in terms of depth and lateral location, is achieved, the lower the cost in completing the well. While many operations are required to drill and complete a well, perhaps the most important is the actual drilling of the bore hole. Drilling directionally to a target formation located a great distance from the surface location of the bore hole is inherently more time consuming than drilling vertically to a target formation directly below the surface location of the bore hole.

There are a number of directional drilling techniques known in the art for drilling a bore hole along a selected trajectory to a target formation from a surface location. A widely used directional drilling technique includes using a hydraulically powered drilling motor in a drill string to turn a drill bit. The hydraulic power to operate the motor is supplied by flow of drilling fluid through the drill string from the earth's surface. The motor housing includes a slight bend, typically ½ to 3 degrees along its axis in order to change the trajectory of the bore hole. One such motor is known as a "steerable motor". A steerable motor can control the trajectory of a bore hole by drilling on one of two modes. The first mode, called rotary drilling mode, is used to maintain the trajectory of the bore hole along the existing azimuth (geodetic direction) and inclination. The drill string is rotated from the earth's surface, such that the steerable motor rotates with the drill string.

The second mode, called "sliding drilling" or "slide drilling", is used to adjust the trajectory. During slide drilling, the drill string is not rotated. The direction of drilling, or the change in bore hole trajectory, is determined by the tool face angle of the drilling motor. The tool face angle is determined by the direction to which the bend in the motor housing is oriented. The tool face can be adjusted from the earth's surface by turning the drill string and obtaining information on the tool face orientation from measurements made in the bore hole by a steering tool or similar directional measuring instrument. Tool face angle information is typically conveyed from the directional measuring instrument to the earth's surface using relatively low bandwidth drilling mud pressure modulation ("mud pulse") signaling or using a relatively high bandwidth cable. The driller (drilling rig operator) attempts to maintain the proper tool face angle by applying torque or drill string angle corrections to the drill string from the earth's surface using a rotary table or top drive on the drilling rig.

Several difficulties in directional drilling are caused by the fact that a substantial length of the drill string is friction contact with and is supported by the bore hole. Because the drill string is not rotating in slide drilling mode, overcoming the friction is difficult. The difficulty in overcoming the friction makes it difficult for the driller to apply sufficient weight on bit (axial force) to the drill bit to achieve an optimal rate of penetration. The drill string also typically exhibits stick/slip motion such that when a sufficient amount of weight is applied to overcome the friction, the weight on the drill bit tends to overshoot the optimum magnitude, and, in some cases, the applied weight to the drill bit may be such that the torque capacity of the drilling motor is exceeded. Exceeding the torque capacity of the drilling motor may cause the motor to stall. Motor stalling is undesirable because the drilling motor cannot drill when stalled and stalling lessens the life of the drilling motor.

Additionally, the reactive torque that would be transmitted from the bit to the surface through the drill string, if the hole were vertical, is absorbed by the friction between the drill string and the bore hole. Thus, during drilling, there is substantially no reactive torque experienced at the surface. Moreover, when the driller applies drill string angle corrections at the surface in an attempt to correct the tool face angle, a substantial amount of the angular change is absorbed by friction without changing the tool face angle. Even more difficult is when the torque applied from the surface overcomes the friction by engaging in stick/slip motion. When enough angular correction is applied to overcome the friction, the tool face angle may overshoot its target, thereby requiring the driller to apply a reverse angular correction. These difficulties make course correction by slide drilling time consuming and expensive as a consequence.

It is known in the art that the frictional engagement between the drill string and the bore hole can be reduced by rotating the drill string back and forth between a first angle and a second angle as measured at the earth's surface or between a first torque value while rotating to the right and a second torque value while rotating to the left. This procedure is known as "rocking". By rocking the drill string, the longitudinal drag that opposes the downward pipe movement is reduced, thereby making it easier for the driller to control the weight on the drill bit and to make appropriate tool face angle corrections. A limitation to using surface angle alone as a basis for rocking the drill string is that it does not account for the friction between the wall of the bore hole and the drill string. Rocking to a selected angle may either not reduce the friction sufficiently to be useful, or may exceed the friction torque of the drill string in the bore hole, thus unintentionally changing the tool face angle of the drilling motor. Further, rocking to tool face angle alone may result in motor stalling if too much weight is suddenly transferred to the drill bit as friction is overcome.

Another difficulty in directional drilling is controlling orientation of the drilling motor during slide drilling. Tool face angle information is measured downhole by a steering tool or other directional measuring instrument and is displayed to the directional driller. The driller attempts to maintain the proper tool face angle by manually applying torque corrections to the drill string. However, the driller typically over- or under-corrects. The over- or under-correction results in substantial back and forth wandering of the tool face angle, which increases the distance that must be drilled in order to reach the target formation. Back and forth wandering also increases the risk of stuck pipe and makes the running and setting of casing more difficult.

A further difficulty in directional drilling is in the transitions back and forth between slide drilling and rotary drilling. Substantial reactive torque is stored in the drill string during both sliding and rotary drilling modes in the form of "wraps" or twists of pipe. During drilling, the drill string may be twisted several revolutions between the surface and the drilling motor downhole. Currently, in transitioning between slide drilling and rotary drilling modes, and back, the drill bit is lifted off the bottom, which releases torque stored in the drill string. When drilling resumes, the drill bit is lowered to the bottom and the reactive torque of the steerable motor must be put back into the drill string before drill bit rotation resumes to a degree such that earth penetration is effective. Moreover, when slide drilling commences, the driller has little control over the tool face angle until the torque applied to the drill string stabilizes at about the amount of reactive torque in the drill string, which adds to the difficulties inherent in controlling direction. As a result, slide drilling has proven to be inefficient and time consuming.

U.S. Pat. No. 7,096,979 entitled, "Continuous On-bottom Directional Drilling Method and System", sharing co-inventors with the present invention, discloses a method of rotary drilling and slide drilling to keep the drill bit in substantially continuous contact with the bottom of the well bore. However, the method as described in the '979 patent is designed for maintaining relatively long periods of slide drilling by employing the "rocking" technique of alternating right hand and left hand torque to the drill string to decrease the friction between the drill string and the wall of the bore hole. The disclosed method also depends on the use of right hand and left hand torque "bumps" (momentary increases of torque above the amount at which the drill string will rotate) to control the orientation of the tool face angle.

Thus, a need exists for an efficient method of and an apparatus for directional drilling with a steerable drilling motor that does not depend upon a rocking technique to control slide drilling while depending upon right hand and left hand torque bumps to maintain tool face angle.

SUMMARY OF THE INVENTION

Drilling a bore hole comprises rotary drilling at a first rotation rate until a first target value is substantially met, changing the first rotation rate to a second rotation rate when a trigger is substantially met, and then drilling at the second rotation rate until a second target value is substantially met. Preferably, the second rotation rate is substantially zero, so the drilling at the second rotation rate is slide drilling. Finally, the steps of rotary drilling at a first rotation rate, changing the rotation rate to a second rotation rate, and drilling at the second rotation rate are repeated.

BRIEF DESCRIPTION OF THE DRAWINGS

The invention and its advantages may be more easily understood by reference to the following detailed description and the attached drawings, in which.

While the invention will be described in connection with its preferred embodiments, it will be understood that the invention is not limited to these. On the contrary, the invention is intended to cover all alternatives, modifications, and equivalents that may be included within the scope of the invention, as defined by the appended claims.

DETAILED DESCRIPTION

Figure 1:
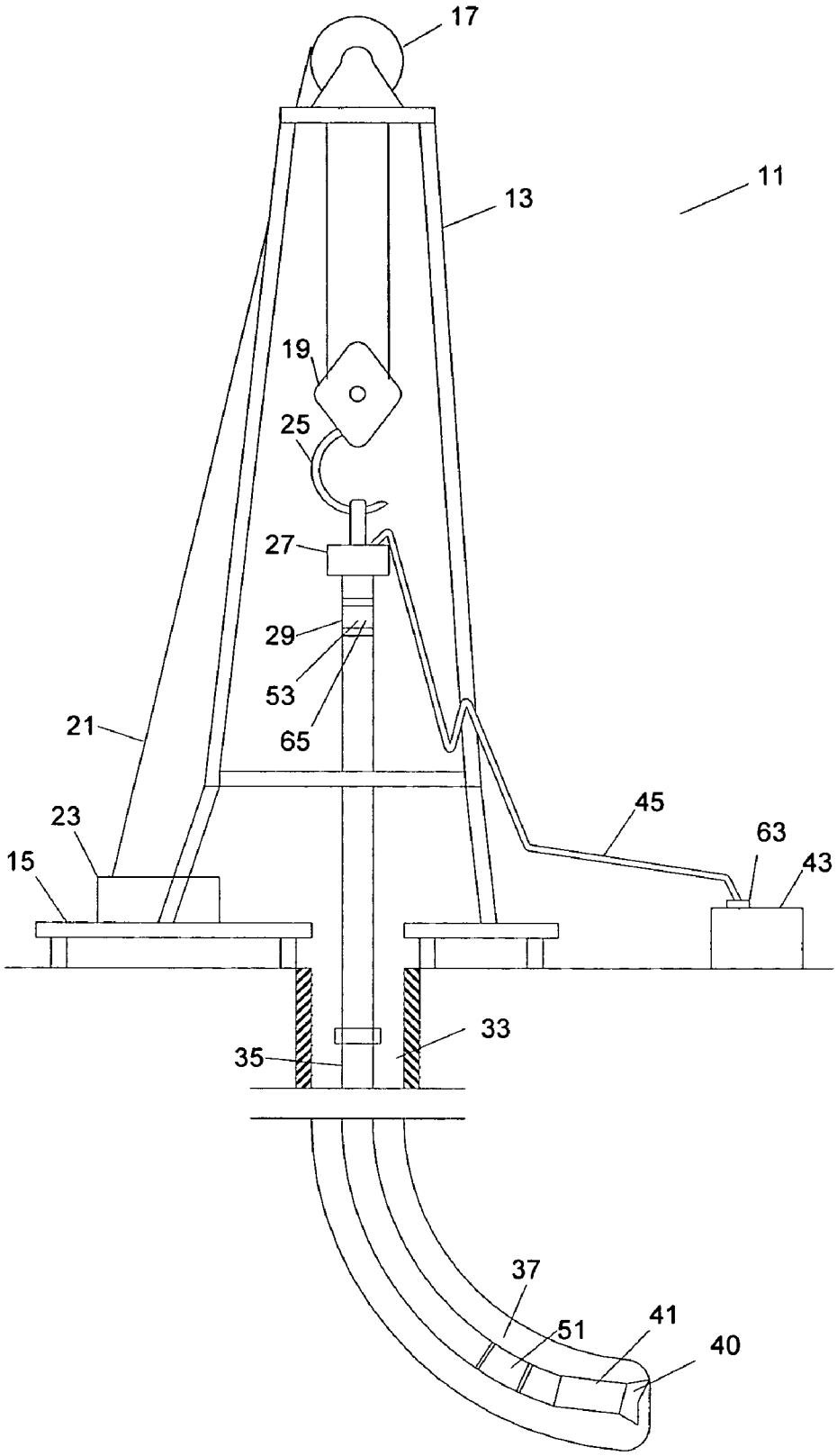
FIG. 1 is a schematic elevational view of a directional drilling system appropriate for the present invention.

FIG. 1 shows a schematic elevational view of a directional drilling system appropriate for the present invention. A drilling rig is designated generally by reference numeral 11. The rig 11 depicted in FIG. 1 is a land rig, but this is for illustrative purposes only, and is not intended to be a restriction on the invention. As will be apparent to those skilled in the art, the method and system of the present invention would apply equally to water-borne rigs, including, but not limited to, jack-up rigs, semisubmersible rigs, and drill ships.

The rig 11 includes a derrick 13 that is supported on the ground above a rig floor 15. The rig 11 includes lifting gear, which includes a crown block 17 mounted to the derrick 13 and a traveling block 19. The crown block 17 and the traveling block 19 are interconnected by a cable 21 that is driven by a draw works 23 to control the upward and downward movement of the traveling block 19. The traveling block 19 carries a hook 25 from which is suspended a top drive 27. The top drive 27 rotatably supports a drill string, designated generally by reference numeral 35, in a well bore 33. The top drive 27 can be operated to rotate the drill string 35 in either direction.

According to one embodiment of the present invention, the drill string 35 can be coupled to the top drive 27 through an instrumented top sub 29, although this is not a limitation on the scope of the invention. A surface drill string torque sensor 53 can be provided. However, the location of the surface torque sensor 53 is not a limitation on the scope off the present invention. A surface drill pipe orientation sensor 65 that provides measurements of drill string angular position or surface tool face can be provided. However, the location of the surface drill pipe orientation sensor 65 is not a limitation of the present invention.

The surface torque sensor 53 may be implemented as a strain gage in the instrumented top sub 29. The torque sensor 53 may also be implemented as a current measurement device for an electric rotary table or top drive motor, or as a pressure sensor for a hydraulically operated top drive, as previously explained. The drill string torque sensor 53 provides a signal which may be sampled electronically. Irrespective of the instrumentation used, the torque sensor 53 provides a measurement corresponding to the torque applied to the drill string at the surface by the top drive or rotary table, depending on how the drill rig is equipped. Other parameters which may be measured, and the corresponding sensors used to make the measurements, will be apparent to those skilled in the art.

The drill string 35 includes a plurality of interconnected sections of drill pipe (not shown separately) and a bottom hole assembly (BHA) 37. The bottom hole assembly 37 may include stabilizers, drill collars and a suite of measurement while drilling (MWD) instruments, including a directional sensor 51. As will be explained in detail below, the directional sensor 51 provides, among other measurements, tool face angle measurements that can be used according to the present invention, as well as bore hole azimuth and inclination measurements.

A steerable drilling motor 41 is connected near the bottom of the bottom hole assembly 37. The steerable drilling motor 41 can be, but is not limited to, a positive displacement motor, a turbine, or an electric motor that can turn the drill bit 40 independently of the rotation of the drill string 35. As is well known to those skilled in the art, the tool face angle of the drilling motor is used to correct or adjust the azimuth and inclination of the bore hole 33 during slide drilling. Drilling fluid is delivered to the interior of the drill string 35 by mud pumps 43 through a mud hose 45. During rotary drilling, the drill string 35 is rotated within the bore hole 33 by the top drive 27. As is well known to those skilled in the art, the top drive 27 is slidingly mounted on parallel vertically extending rails (not shown) to resist rotation as torque is applied to the drill string 35. During slide drilling, the drill string 35 is held rotationally in place by the top drive 27 while the drill bit 40 is rotated by the drilling motor 41. The drilling motor 41 is ultimately supplied with drilling fluid by the mud pumps 43 through the mud hose 45 and through the drill string 35.

The driller can operate the top drive 27 to change the tool face orientation of the drilling motor 41 by rotating the entire drill string 35. A top drive 27 for rotating the drill string 35 is illustrated in FIG. 1, but that is for illustrative purposes only, and is not intended to limit the scope of the present invention. Those skilled in the art will recognize that the present invention may also be used in connection with other equipment used to turn the drill string at the earth's surface. One example of such other equipment is a rotary table and Kelly bushing (neither shown) to apply torque to the drill string 35. The cuttings produced as the drill bit 40 drills into the earth are carried out of the bore hole 33 by the drilling fluid supplied by the mud pumps 43.

The discharge side of the mud pumps 43 includes a drill string pressure sensor 63. The drill string pressure sensor 63 may be in the form of a pump pressure transducer coupled to the mud hose 45 running from the mud pumps 43 to the top drive 27. The pressure sensor 63 makes measurements corresponding to the pressure inside the drill string 35. The actual location of the pressure sensor 63 is not intended to limit the scope of the invention. Some embodiments of the instrumented top sub 29, for example, may include a pressure sensor.

Figure 2:
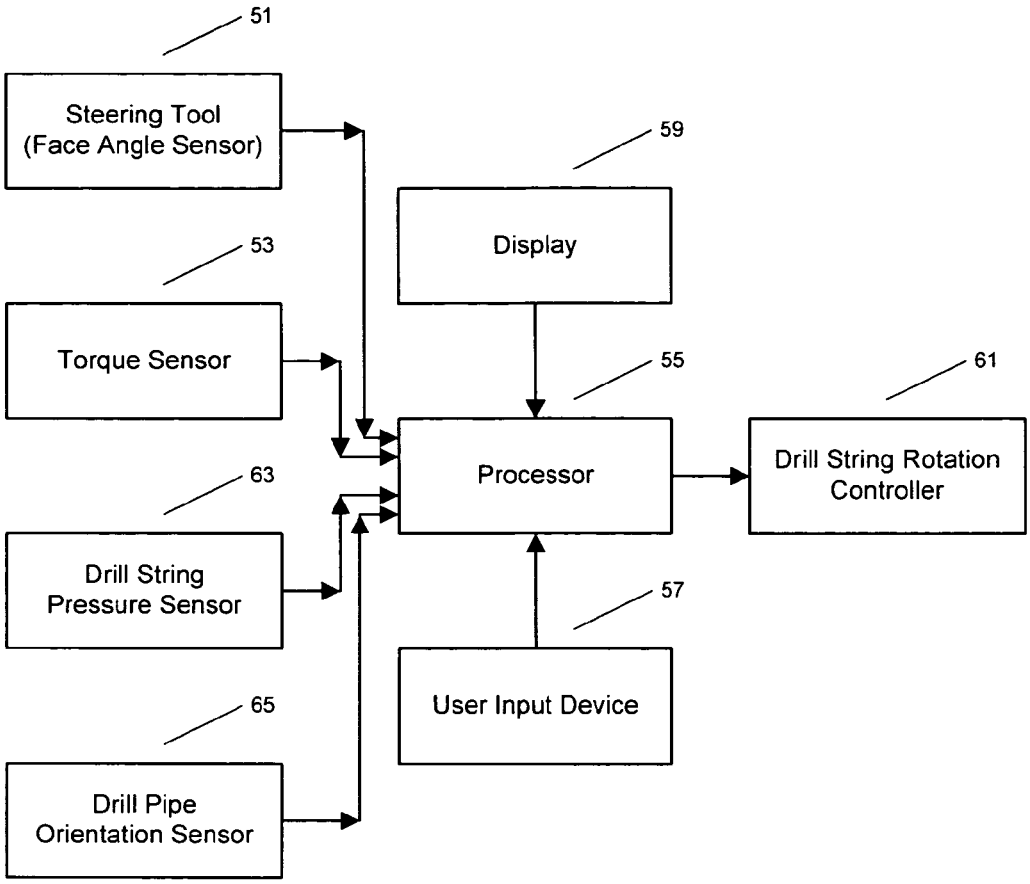
FIG. 2 is a block diagram of a directional drilling control system according to an embodiment of the present invention.

FIG. 2 shows a block diagram of a directional drilling control system according to an embodiment of the present invention. The system of the present invention includes a steering tool or directional sensor 51 which produces a signal indicative of the tool face angle of the steerable motor 41. The system includes a drill string torque sensor 53. The torque sensor 53 provides a measure of the torque applied to the drill string at the surface. The system includes a drill string pressure sensor 63 that provides measurements of the drill string pressure. The system includes a surface drill pipe orientation sensor 65 that provides measurements of drill string torque. In FIG. 2 the outputs of directional sensor 51, the torque sensor 53, the pressure sensor 63, and the drill pipe orientation sensor 65 are received at or otherwise operatively coupled to a processor 55. The processor 55 is programmed, according to the present invention, to process signals received from the sensors 51, 53, 63, and 65. The processor also receives user input from user input devices, indicated generally at 57. User input devices 57 may include, but are not limited to, a keyboard, a touch screen, a mouse, a light pen, or a keypad. The processor 55 may also provide visual output to a display 59. The processor also provides output to a drill string rotation controller 61 that operates the top drive or rotary table to rotate the drill string in a manner according to the present invention.

Figure 3:
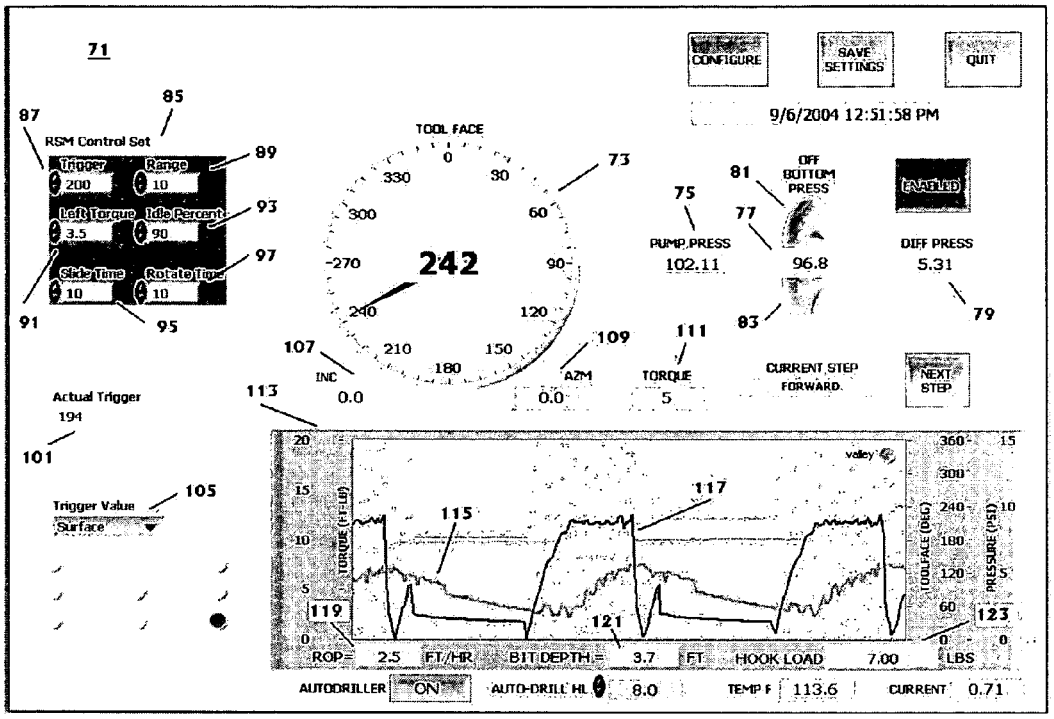
FIG. 3 is a pictorial view of a driller's screen according to an embodiment of the present invention.

FIG. 3 shows a pictorial view of a driller's screen according to an embodiment of the present invention. Driller's screen 71 displays pertinent drilling information to the driller (drilling rig operator) and provides a graphical user interface to the system of the present invention. The user interface may, for example, be in the form of a touch screen such as sold under the trade name FANUC by General Electric Co., Fairfield, Conn., USA.

Screen 71 includes a tool face indicator 73, which displays the tool face angle derived from the output of the steering tool. In the illustrated embodiment, the tool face indicator 73 is implemented as a combination dial and numerical indicator. Screen 71 includes a pump pressure indicator 75, an off-bottom pressure indicator 77, and a differential pressure indicator 79. The pump pressure indicator 75 displays drilling fluid pressure information derived from the pressure sensor 63 (FIG. 2). The off-bottom pressure indicator 77 displays drilling fluid pressure when the drill bit is off the bottom of the bore hole (and thus the steerable drilling motor is exerting substantially no torque). The differential pressure indicator 79 displays the difference between the off-bottom pressure and the drilling fluid pressure when the drill bit is on the bottom of the bore hole and is drilling an earth formation, and thus the drilling motor is exerting substantial torque.

As is well known to those skilled in the art, differential pressure is related to weight on bit. The higher the weight on bit is, the higher the differential pressure is because the torque exerted by the drilling motor increases correspondingly. In directional drilling, it is often difficult to determine the weight on bit directly from measurements of the weight of the drill string made at the earth's surface because of friction between the drill string and the wall of the bore hole. Accordingly, weight on bit is typically inferred from differential pressure. Before commencing rotary drilling according to the present invention, the driller begins circulating drilling fluid while the drill bit is off the bottom of the bore hole. The driller can input the off-bottom drilling fluid pressure to the system. The off-bottom pressure is displayed in the off-bottom indicator 77 and used to calculate the differential pressure for display in the differential indicator 79. The off-bottom pressure indicator 77 is accompanied by off-bottom pressure controls. An up arrow control 81 increases the off-bottom pressure when activated, while a down arrow control 83 decreases the off-bottom pressure when activated.

Screen 71 includes a RSM (Rotary Steerable Motor) Control Set 85. The RSM Control Set includes six combination controls with both up arrow and down arrow controls and numerical displays. The controls and displays are for the trigger value 87, the range 89 for the trigger value, the left torque value 91, the idle percent 93, the slide time 95, and the rotate time 97. An actual trigger indicator 101 displays the measured result for the driller. A trigger value selector 105 allows the driller to choose which type of trigger to use.

Screen 71 also displays the inclination indicator 107, azimuth indicator 109, and torque indicator 111 beneath and to the right of the tool face indicator 73. A graphical display 113 shows plots of differential pressure vs. time 115 and torque vs. time 117 for the driller. Surface rate of penetration, bit depth, and hook load (weight of the drill string measured at the earth's surface) are displayed in indicator boxes 119, 121, and 123, respectively.

Figure 4:
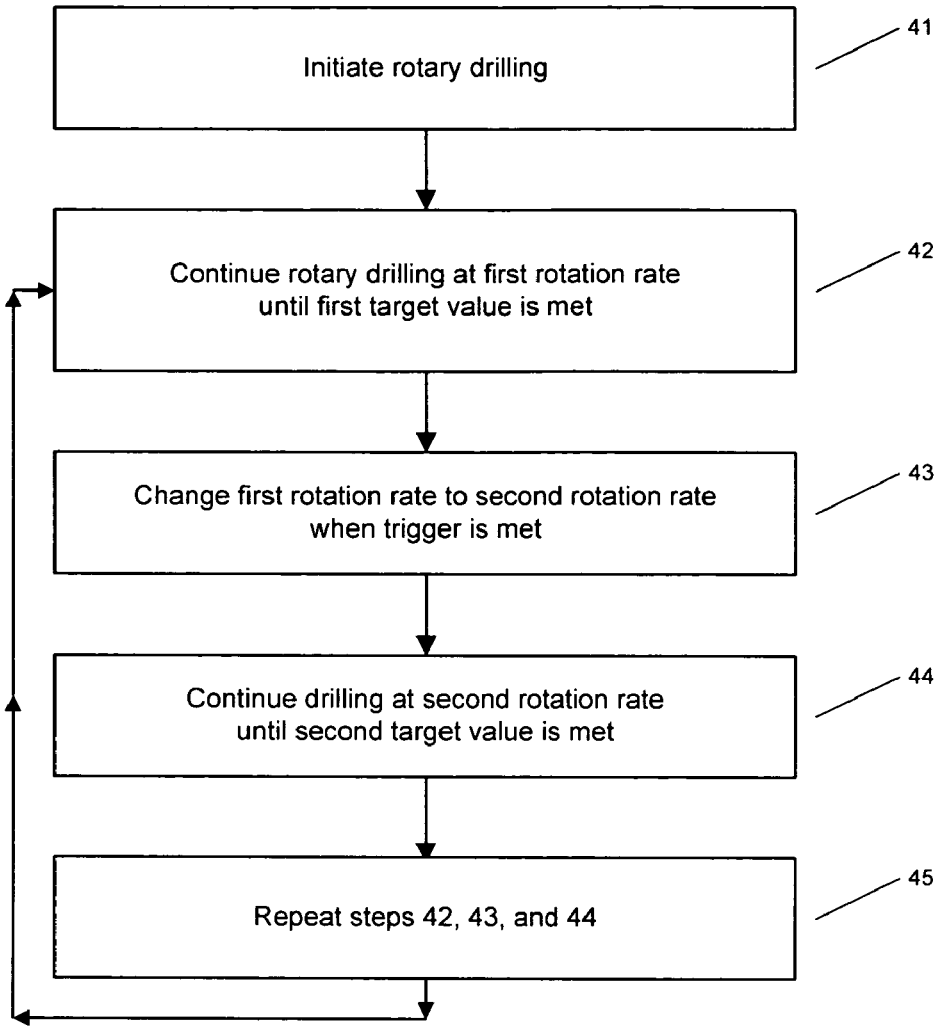
FIG. 4 is a flowchart illustrating the steps of an embodiment of the method of the invention for drilling a bore hole.

FIG. 4 shows a flowchart illustrating an embodiment of the method of the invention for drilling a bore hole. The flowchart in FIG. 4 gives a general view of the method of the invention for alternating between rotary drilling and slide drilling in drilling a directional well. Details of the method are described further in the flowcharts discussed with reference to FIGS. 5 and 6, below.

The invention in general terms is a method for directionally drilling a bore hole with a steerable drilling motor. The method includes alternating between two drilling modes with two different drill string rotation rates to keep the tool face angle near a desired orientation for as much of the time as possible. The method sets targets to aid in determining when drilling at a particular drill string rotation rate has continued long enough. The method uses triggers to determine when to take a specific action, such as changing from the first to the second drill string rotation rate. For example, a first target is checked to determine when the drilling at the first rotation rate has gone on long enough. Then a first trigger is checked to determine when to change to the second rotation rate. Then, a second target is checked to determine when drilling at the second rotation rate has gone on long enough. The method returns to the first rotation rate to continue the process of alternating between the two drilling rotation rates.

At 41, rotary drilling is initiated. The procedures for initiating rotary drilling are described below with reference to the flowchart in FIG. 5.

At 42, rotary drilling is continued at a first rotation rate until a first target is met. In one embodiment, the first target for determining when to start checking for the first trigger is a parameter that is based on weight on bit. This parameter would include, but not be limited to, weight on bit itself, differential pressure (defined above), or downhole reactive torque. In an alternative embodiment, the first target is a pre-selected time period. The procedures for determining whether the first target is met are described below with reference to the flowchart in FIG. 6.

At 43, the first rotation rate is changed to a second rotation rate when a first trigger is substantially met. In one embodiment, the drill string rotation rate of the rotary drilling is decreased to a slower rate. In the present embodiment, the rotation speed for rotary drilling alternates between a first, high rotation rate, such as about 40 revolutions per minute (rpm), and a second, low rotation rate, such as about 5-10 rpm. The slow down in rotation rate is not enough to change the drilling mode from rotary drilling to slide drilling. The slow down only causes the surface applied torque to the drill string to temporarily decline below rotary drilling torque (the amount of surface applied torque needed to keep the drill string rotating) during the drilling at the second rotation rate for a short period of time. The purpose of slowing the rotation rate of the drill string is to spend more time drilling within a range, for example 90°, of a desired tool face angle than drilling in a range away from the desired tool face angle.

In one embodiment, the first trigger for determining when to change from the first rotation rate to the second rotation rate is a measurement of tool face angle. In an alternative embodiment, the first trigger for changing rotation rates is substituted by making the changes after preselected time periods. The procedures for determining whether the first trigger is substantially met are described below with reference to the flowchart in FIG. 6.

At 44, drilling is continued at the second rotation rate until a second target is substantially met. In one embodiment, the drilling rate is a slow rotation rate as described above and so the drilling mode remains rotary drilling. In another embodiment, the second rotation rate is substantially zero and so the drilling mode is slide drilling. In this second embodiment, the drilling mode is changing from rotary drilling at the first rotation rate to slide drilling at the second, substantially zero rotation rate and then back to the first rotation rate.

In one embodiment, the second target for changing back to rotary drilling at the first rotation rate is a parameter that is based on weight on bit. This parameter would include, but not be limited to, weight on bit itself, differential pressure, or downhole reactive torque. In an alternative embodiment, the second target for changing back is a pre-selected time period. The procedures for determining whether the second target is substantially met are described in more detail below with reference to the flowchart in FIG. 6.

If the drilling method described above is repeated in a consistent manner, then the tool face angle during the second rate of rotation should be substantially the same every time. By changing any one of the target and trigger values, the tool face during the second rate of rotation can be sufficiently controlled. For example, the first trigger point may be adjusted until the tool face angle during the second rate of rotation (typically slide drilling) begins to fall into a desired tool face window.

At 45, the process returns to 42 to repeat elements 42-44, thus alternating between rotary drilling at the first rotation rate and rotary or slide drilling at the second rotation rate. The method of the invention, as described herein, may be performed manually or automated. Automation increases the accuracy and repeatability of the process, which thus increases the success rate or effectiveness of using the present invention.

Figure 5:
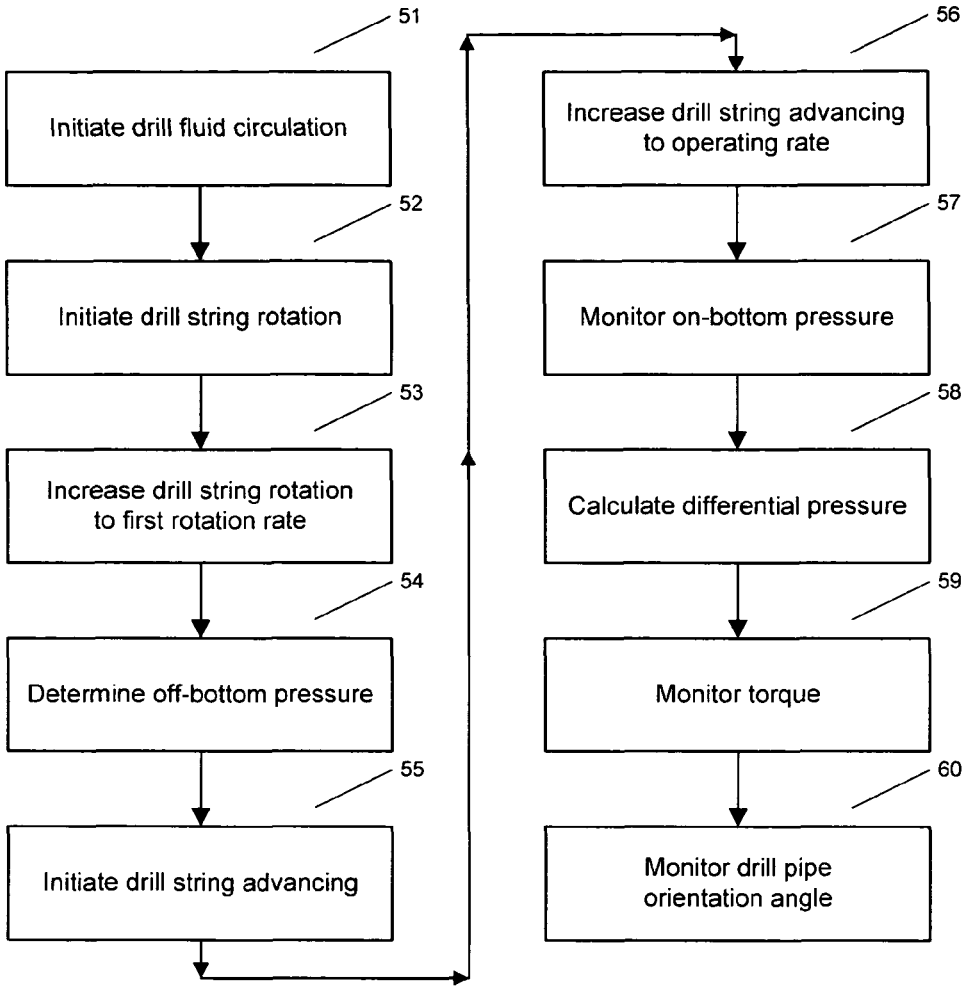
FIG. 5 is a flowchart illustrating the steps of an embodiment of the method of the invention for initiating the drilling of a bore hole.

FIG. 5 shows a flowchart illustrating an embodiment of the method of the invention for initiating the drilling of a bore hole. The flowchart in FIG. 5 describes in more detail the method of the invention shown at 41 of the flowchart in FIG. 4, above. At 51, drilling fluid circulation is initiated. At 52, drill string rotation is initiated. The driller starts rotating the drill string using the top drive, rotary table, or other equipment on the drill rig. At 53, the rate of drill string rotation is increased to the first rotation rate. In a preferred embodiment, the first rotation rate is a desired operating rotation rate. At 54, off-bottom pump pressure is determined. The off-bottom pressure may then be used later to calculate the differential pressure.

At 55, axially advancing the drill string (drilling ahead) is initiated. At 56, the rate of advancing the drill string is adjusted to a desired operating advancing rate. The operating advancing rate is preferably the rate that maintains the desired differential pressure or weight on bit (hook load). Alternatively, the operating advancing rate is the rate that maintains a desired surface-measured rate of penetration. At 57, on-bottom pump pressure is monitored. At 58, differential pressure is calculated from the difference of the off-bottom pressure from 54 and the on-bottom pressure from 57. At 59, torque is monitored. At 60, drill pipe orientation angle (surface tool face angle) is monitored.

Figure 6:
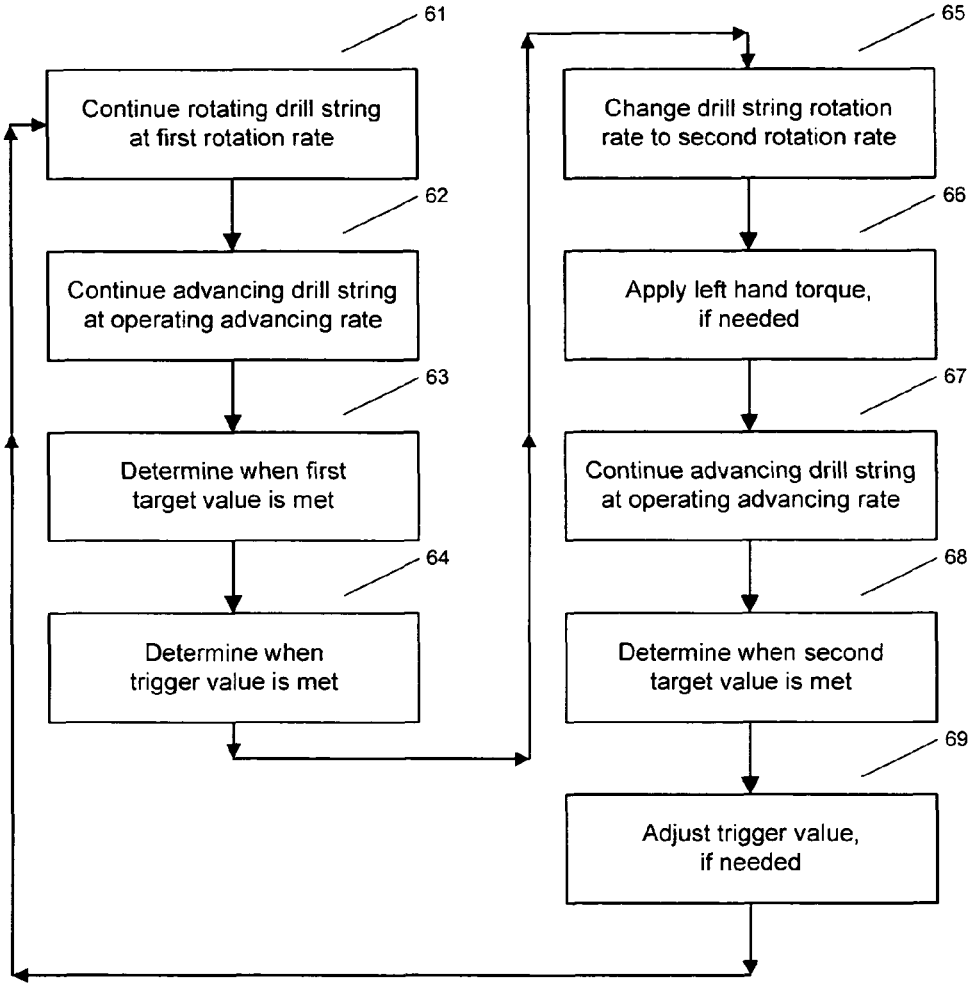
FIG. 6 is a flowchart illustrating the steps of an embodiment of the method of the invention for alternating rotary drilling and slide drilling.

FIG. 6 shows a flowchart illustrating an embodiment of the method of the invention for alternating rotary drilling and slide drilling. The flowchart in FIG. 6 describes in more detail the method of the invention shown at 42-43 of the flowchart in FIG. 4, above.

At 61, the drill string is rotated at the first rotation rate. In a preferred embodiment, the first rotation rate is a desired operating rotation rate. The driller brings the rate of rotation of the drill string up to the operating rate.

At 62, the drill string is axially advanced at an operating advancing rate. The driller brings the rate of drill string advancement up to the operating rate. The operating advancement rate is preferably the rate that maintains the desired differential pressure or weight on bit. Alternatively, the operating advancing rate is the rate that maintains a desired surface rate of penetration.

At 63, it is determined when the first target value is substantially met. In one embodiment, the first target is differential pressure. The driller can monitor the differential pressure on the driller's screen until a desired target value is substantially met. The target differential pressure value is preferably the recommended operating differential pressure of the drilling motor, perhaps less a safety factor. The target differential pressure value may be defined within a range of the first target value.

In an alternative embodiment, the first target is time. A time value can be preset. Typically, this time value may be of the order of approximately 10 seconds. This time value is preferably selected so that the differential pressure has had sufficient time to rise to the desired level.

For any of the embodiments of first target value, when the first target value is substantially met, then the process continues to step 64 to begin checking for the first trigger value.

At 64, it is determined when the first trigger value is substantially met. Preferably, the first trigger value to be met is defined within a range on both sides of the trigger value. Using a range is a more realistic approach to meeting a trigger value.

In a preferred embodiment, the first trigger is tool face angle. The driller may monitor tool face angle from the driller's screen and determine from steering tool measurements the prevailing tool face angle during the second rotation rate (typically slide drilling). Although the desired tool face angle of the current drilling cycle is the desired end, the first trigger tool face angle will have to be a different value to account for the inertia of the drill string. Stopping rotation of the drill string at the surface does not instantly stop the drill string at the bit. Thus the first trigger value will have to be a value of the tool face angle that leads to the desired tool face angle when the tool face stops changing orientation. Discovering an appropriate trigger value may take a process of trial and error or may be gleaned from previous experience.

In an alternative embodiment, the first trigger is not based on a given parameter, but is simply a random action. As an example, if randomly stopping the rotation of the drill string brings about a tool face angle substantially close to the desired tool face angle, then slide drilling continues. In one embodiment, substantially close is defined as within a preselected range of the desired tool face angle.

In another embodiment, torque can be a trigger. Torque may be measured at the bottom-hole, at the surface, or anywhere in the bore hole.

For any of the embodiments of trigger value, when the first trigger value is substantially met, then the process continues to step 65 to change over to drilling at the second rotation rate.

At 65, the rate of rotation of the drill string is changed to the second rotation rate. In one embodiment, the rate of rotation is decreased from a relatively higher first rotation rate to a relatively lower second rotation rate. In another embodiment, the second rotation rate is substantially zero. In this embodiment, the drilling mode at a zero rotation rate is now slide drilling instead of rotary drilling. The rate of advance of the drill string is kept constant. Alternately, the surface rate of penetration of the drill string is kept constant.

At 66, a left hand torque is applied. This is an optional step that is applied when needed. Left hand torque, also called a left torque bump, is the amount of counter-clockwise ("to the left", as it is known in the art) torque applied to the drill string at the surface. Since normal rotation of the drill pipe is clockwise ("to the right", as it is known in the art), left hand torque is a opposite direction drill pipe rotation. A left torque bump is an extra small amount of left hand torque applied to hold the drill string relatively motionless during the slide drilling step. In practice, the left hand torque is applied until a second trigger, a preset left torque value, is reached before settling to the second rotation rate.

At 67, the drill string is axially advanced at the operating advancing rate. As described above, the operating advancing rate may be the rate that maintains a desired differential pressure, weight on bit, or surface rate of penetration.

At 68, it is determined when the second target value is substantially met. In one embodiment, the second target is differential pressure. The driller can monitor the differential pressure on the driller's screen until a desired target value is substantially met. The differential pressure value is decreasing and the driller can pick a value close to zero as the second target value. The target differential pressure value may be defined within a range of the second target value.

In an alternative embodiment, the second target is time. A time value can be preset on the driller's screen. Typically, this time value may be of the order of approximately 10 seconds. This time value is preferably selected so that the differential pressure has had sufficient time to decrease to the desired level. When the second target value is substantially met, then the process returns to 61 to repeat rotary drilling at the first rotation rate again.

At 69, the first trigger value is adjusted, if needed. The first trigger value is adjusted until the tool face angle during the second rate of rotation begins to fall into the desired tool face window. This adjustment may take a few cycles of trial and error. As a consequence, the downhole tool face during the second rate of rotation can be controlled sufficiently to be substantially the same every time.

It should be understood that the preceding is merely a description of specific embodiments of this invention and that numerous changes, modifications, and alternatives to the disclosed embodiments can be made in accordance with the disclosure here without departing from the scope of the invention. The preceding description, therefore, is not meant to limit the scope of the invention. Rather, the scope of the invention is to be determined only by the appended claims and their equivalents.

We claim:

1. A method for directional drilling a subterranean borehole, the method comprising:

(a) deploying a drill string in a borehole, the drill string including a plurality of interconnected sections of drill pipe and a bottom hole assembly including a drilling motor and a drill bit, the drilling motor including a bent housing along its axis;

(b) causing the drilling motor to rotate the drill bit relative to the drill string;

(c) rotary drilling the borehole by rotating the drill string from a surface location at a first high rotation rate;

(d) rotary drilling the borehole by rotating the drill string from the surface location at a second low rotation rate;

(e) repeating (c) and (d) a plurality of times so as to continuously rotary drill the borehole using a drill string rotation rate that alternates back and forth between the first high rotation rate and the second low rotation rate without slide drilling.

2. The method of claim 1, wherein the drilling motor continuously rotates in the borehole in (c), (d), and (e).

3. The method of claim 1, wherein the rotary drilling in (c), (d), and (e) does not include slide drilling.

4. The method of claim 1, wherein said continuous rotary drilling in (e) causes the drill bit to spend more time rotary drilling the borehole within a first range of tool face angles about a predetermined tool face angle than within a second range of tool face angles away from the predetermined tool face angle.

5. The method of claim 4, wherein the first range of tool face angles is about 90 degrees.

6. The method of claim 4, wherein said causing the drill bit to spend more time rotary drilling the borehole within a first range of tool face angles causes a drilling direction to turn towards the predetermined tool face angle.

7. The method of claim 1, wherein the first rotation rate in (c) is changed to the second rotation rate in (d) when a first trigger is substantially met, the first trigger being a tool face angle.

8. The method of claim 1, wherein the second rotation rate is in a range from about 5 to about 10 rpm.

9. A method for directional drilling a subterranean borehole, the method comprising:

(a) deploying a drill string in a borehole, the drill string including a plurality of interconnected sections of drill pipe and a bottom hole assembly including a drilling motor and a drill bit, the drilling motor including a bent housing along its axis;

(b) causing the drilling motor to rotate the drill bit relative to the drill string; and (c) continuously rotary drilling the borehole, said continuous rotary drilling consisting of (i) rotating the drill string from a surface location at first high rotation rate; (ii) rotating the drill string from the surface location at a second low rotation rate, and (iii) repeating (i) and (ii) such that rotation of the drill string alternates back and forth between the high rotation rate and the low rotation rate without slide drilling.

10. The method of claim 9, wherein the drilling motor continuously rotates in the borehole in (c).

11. The method of claim 9, wherein the rotary drilling in (c) does not include slide drilling.

12. The method of claim 9, wherein said continuous rotary drilling in (c) causes the drill bit to spend more time rotary drilling the borehole within a first range of tool face angles about a predetermined tool face angle than within a second range of tool face angles away from the predetermined tool face angle.

13. The method of claim 12, wherein the first range of tool face angles is about 90 degrees.

14. The method of claim 12, wherein said causing the drill bit to spend more time rotary drilling the borehole within a first range of tool face angles causes a drilling direction to turn towards the predetermined tool face angle.

15. The method of claim 8, wherein the second rotation rate is in a range from about 5 to about 10 rpm.

* * * * *